US005155493A

United States Patent [19]

Thursby et al.

[11] Patent Number: 5,155,493

[45] Date of Patent: Oct. 13, 1992

[54] TAPE TYPE MICROSTRIP PATCH ANTENNA

[75] Inventors: Michael H. Thursby, Palm Bay; Barry G. Grossman, Satellite Beach, both of Fla.; Wesley W. Shleton, Atlanta, Ga.; Robert A. Murphey; G. Edward Keller, Jr., both of Walton Beach, Fla.

[73] Assignee: The United States of America as represented by the Secretary of the Air Force, Washington, D.C.

[21] Appl. No.: 578,034

[22] Filed: Aug. 28, 1990

[51] Int. Cl.[5] ..... H01Q 1/38

[52] U.S. Cl. ..... 343/700 MS; 343/745; 343/873

[58] Field of Search ..... 343/700 MS, 705, 713, 343/795, 872, 873, 897, 745

[56] References Cited

U.S. PATENT DOCUMENTS

| | | | |
|---|---|---|---|
| 3,005,986 | 10/1961 | Reed | 343/708 |
| 3,996,529 | 12/1976 | Curtice | 331/99 |
| 4,414,550 | 11/1983 | Tresselt | 343/700 MS |
| 4,751,513 | 6/1988 | Daryoush et al. | 343/700 MS |
| 4,806,941 | 2/1989 | Knochel et al. | 343/700 MS |
| 4,816,836 | 3/1989 | Lalezari | 343/700 MS |
| 4,835,541 | 5/1989 | Johnson et al. | 343/713 |

FOREIGN PATENT DOCUMENTS

| | | | |
|---|---|---|---|
| 221007 | 12/1984 | Japan | 343/700 MS |
| 208903 | 9/1986 | Japan . | |
| 2046530 | 11/1980 | United Kingdom | 343/700 MS |

*Primary Examiner*—Michael C. Wimer

*Attorney, Agent, or Firm*—Bernard E. Franz; Donald J. Singer

[57] ABSTRACT

Single or multiple players of electrically insulating tape have adhesive applied to one surface for the dielectric of the patch antenna. Electrically conductive foil tape with adhesive applied to one surface is used to create the radiating element and the ground plane. The antenna structure can then be mounted to the desired surface by means of structural tape adhesives. The resultant sandwich structure forms a highly flexible, low profile, low cost, rugged conformal antenna for radiating radio frequency energy. Modification and control of the electrical and performance characteristics of the antenna can be accomplished by non-uniform thickness of the dielectric, using insulating tape sections which differ in dielectric constant, incorporating PIN diodes with optical of electrical control, etc.

12 Claims, 3 Drawing Sheets

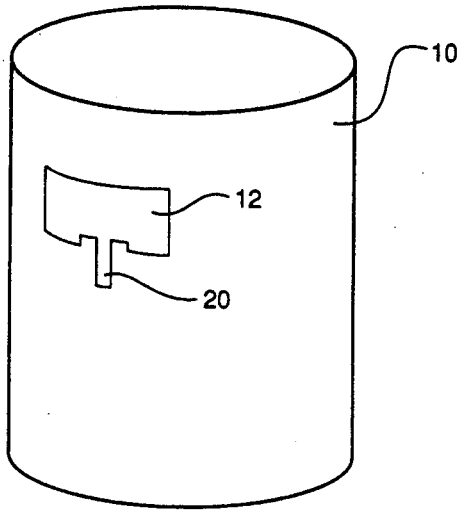
Fig. 1
Fig. 1a
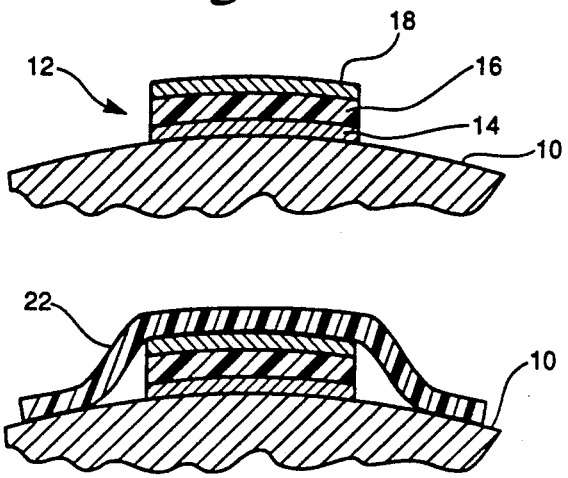
Fig. 1b
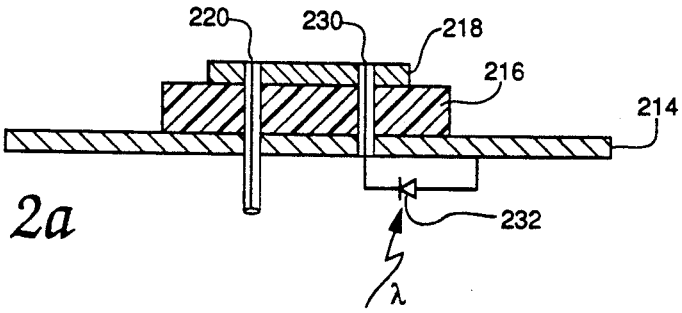
Fig. 2a
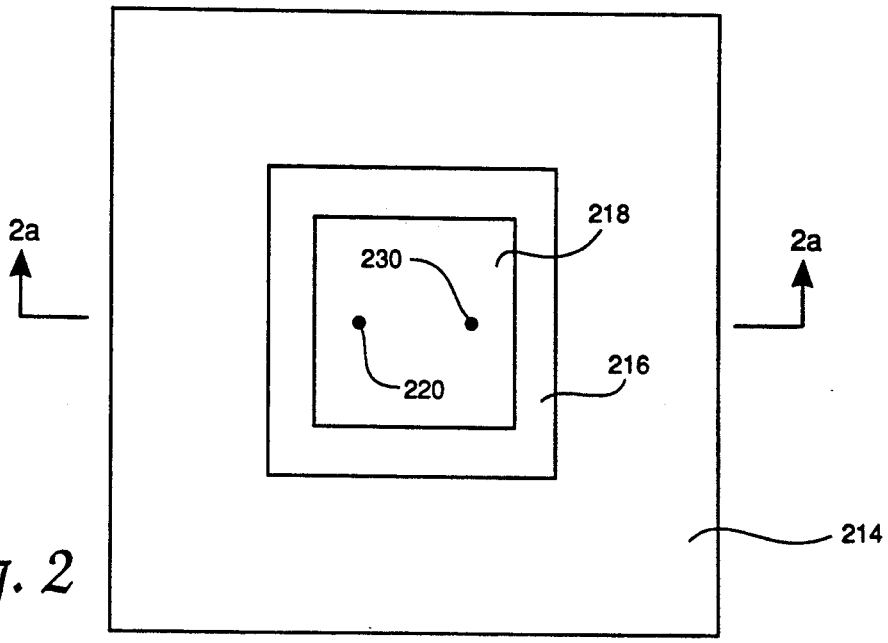
Fig. 2

TAPE TYPE MICROSTRIP PATCH ANTENNA

RIGHTS OF THE GOVERNMENT

The invention described herein may be manufactured and used by or for the Government of the United States for all governmental purposes without the payment of any royalty.

BACKGROUND OF THE INVENTION

The present invention relates generally to a tape type microstrip patch antenna.

Conventionally, microstrip patch antennas are fabricated from printed circuit board materials which consist of a uniform thickness of TEFLON® fiberglass, or a similar type dielectric layer, which has copper layers laminated on both top and bottom surfaces. The appropriate pattern for the patch is then photlithographically defined on the top surface of the copper and the unwanted copper is chemically etched away leaving the desired patch. The bottom copper layer forms the ground plane for the antenna. Due to the nature of the materials and fabrication process, these antennas do not lend themselves to low cost mass production, and do not afford the possibility of quick and simple conformal mounting on differing types of non-planar surfaces, such as aircraft, projectiles, etc. These etched antennas are subject to failure of the dielectric due to flexing.

United States patents of interest include U.S. Pat. No. 4,414,550, to Tresselt which relates to a low profile circular array antenna and related microstrip elements. This patent describes an embodiment wherein copper foil tape is soldered to plates of copper cladding on a standard TEFLON® fiberglass stripline board in construction of antenna elements comprised of two patch dipoles. Johnson et al patent No. 4,835,541 relates to a conformal mobile vehicle antenna which involves the use of strips of conductive aluminum tape to establish conductive bonding between other components. Curtice patent No. 3,996,529 is of general interest in that it relates to a varacter tuning apparatus for a microstrip transmission line device which incorporates an insulating material of self adhesive TEFLON® tape.

SUMMARY OF THE INVENTION

An objective of the invention is to provide an antenna which is simple and easily adaptable to various mounting conditions.

The invention is directed to a tape-based microstrip patch antenna wherein single or multiple layers of electrically insulating tape have adhesive applied to one surface for the dielectric of the patch antenna. Electrically conductive foil tape with adhesive applied to one surface is used to create the radiating element and the ground plane. The antenna structure can then be mounted to the desired surface by means of structural tape adhesives. The resultant sandwich structure forms a highly flexible, low profile, low cost, rugged conformal antenna for radiating radio frequency energy. Modification and control of the electrical and performance characteristics of the antenna is provided for as more particularly described in the detailed description herein.

The invention comprises a device and related fabrication techniques which bring together a combination of technologies not previously applied to the fabrication and design of microstrip patch antennas.

Features

- Antenna can be fabricated in bulk rolls (peel and stick) at low cost.
- Antennas are highly flexible and can be made very thin thus will conform to the surface on which it is applied
- Design allows for great flexibility in the manufacturing process.
- Dielectric structure can be non-uniform in thickness and inhomogeneous in composition.
- Eliminates present technology reliance on laminating process for fabrication.
- Use of structural adhesives provides an extremely strong bond to the underlying structure but can easily be removed by application of proper solvent.
- Non-homogeneous dielectric thickness can be achieved easily.
- Shaped dielectric and ground plane (including non-continuous) can be fabricated easily.
- Antenna thickness can be changed by adding or removing layers of the dielectric tape thus allowing the adjustment of the antenna characteristics even and at the time of application.
- Multiple frequency resonances may be possible with certain inhomogeneous tape configurations.

BRIEF DESCRIPTION OF THE DRAWING

FIG. 1 is a diagram showing a tape type microstrip patch antenna mounted on a cylindrical surface;

FIG. 1*a* is a cross section view of the antenna of FIG. 1;

FIG. 1*b* is a cross section view corresponding to that of FIG. 1*a*, with a tape radome added;

FIGS. 2 and 2*a* are top and cross section views respectively of a microstrip patch antenna with a diode for controlling the characteristics;

DETAILED DESCRIPTION

Figure 3:
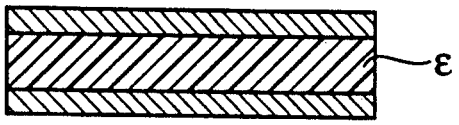
FIGS. 3–6 are cross section views.

The invention is disclosed in a report AFATL-TR-89-27 by M. Thursby et al titled "Subminiature Telemetry Antenna Study", available as of Nov. 2, 1989 from the Defense Technical Information Center (DTIC) as AD-B137 538. A copy of this report is attached hereto as an appendix, and is hereby incorporated by reference.

The tape-based microstrip patch antenna incorporates single or multiple layers of electrically insulating tape with the adhesive applied to one surface for the dielectric of the patch antenna. Electrically conductive foil tape with adhesive applied to one surface is used to create the radiating element and the ground plane. The antenna structure can then be mounted to the desired surface by means of structural tape adhesives. The resultant sandwich structure forms a highly flexible, low profile, low cost, rugged conformal antenna for radiating radio frequency energy. It can be easily produced at low cost and is quick and simple to install and remove.

FIG. 1 shows a cylindrical surface 10 on which a tape-based microstrip patch antenna 12 is mounted. This embodiment shows a strip line type feed 20. FIG. 1*a* is a cross section view of the antenna 12 of FIG. 1, showing electrically conductive foil tape 14 applied to the surface 10 as a ground plane, electrically insulating tape 16 applied over the ground plane for the dielectric, and electrically conductive foil tape 18 applied over the tape 16 as the radiating element. FIG. 1*b* shows the same antenna with insulating tape 22 added over the entire structure as a radome.

The fabrication of a patch antenna, with a coaxial feed as shown at point 220 in FIGS. 2 and 2*a*, (without the diode 232) may comprise the following steps:

1. A bare copper substrate 214 is used for the ground plane in the tape antenna structure.
2. A hole to pass the feed structure through the ground plane is punched in a position that will allow the patch to be placed approximately in the center of the ground plane.
3. The ground plane is cleaned to provide a good soldering surface and improve adhesion of the tape elements to the surface.
4. A ring is tinned around the hole.
5. After an interface connector is tinned the two are soldered together with the center conductor of the SMA connection centered in the feed hole.
6. PTFE dielectric tape 216 is applied to the ground plane in a manner that will allow the patch to be placed on top of the stacked layer of dielectric.
7. The active radiating element 218 is placed on top of the dielectric and the feed point 220 is soldered to the active element.
8. The entire antenna is covered with a radome (as shown in FIG. 1*b*) to protect the surface element and provide an integrated antenna structure.

Modification and control of the electrical and performance characteristics of the antenna can be incorporated into the tape dielectric layer by embedding electrically or optically controlled devices (e.g. PIN diodes) into the antenna substructure at the time of the tape application thus reducing the number of steps required in the fabrication process of such controlled structures. Optical waveguide structures such as optical fibers or polymer planar waveguides can also be integrated into the structure at the same time the dielectric materials are being laid down. This will allow the use of guided optical waves to control the electrical devices to alter the antenna characteristics.

FIGS. 2 and 2*a* show an optically controlled diode 232 having its cathode connected to the radiating element at point 230 and its anode connected to the ground plane 214. An optical waveguide structure (not shown) may be integrated into the patch antenna to illuminate the diode 232.

Figure 8:
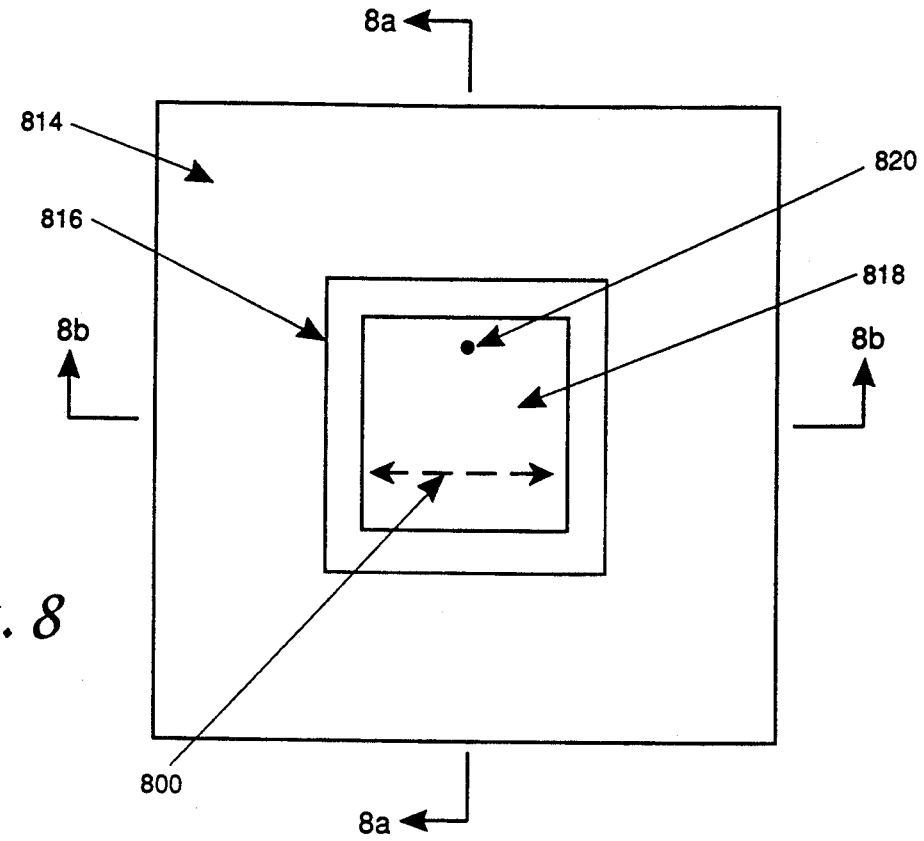
FIG. 8 is a top view of an embodiment of the patch antenna with an optically controlled diode and an embedded optical waveguide.
Figure 8A:
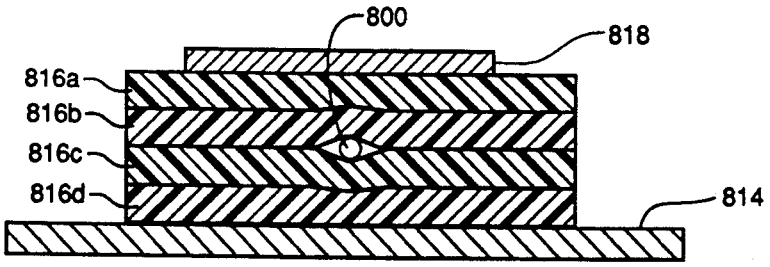
FIGS. 8*a* and 8*b* are cross section views taken respectively along lines 8*a*—8*a* and 8*b*—8*b* of FIG. 8.
Figure 8B:
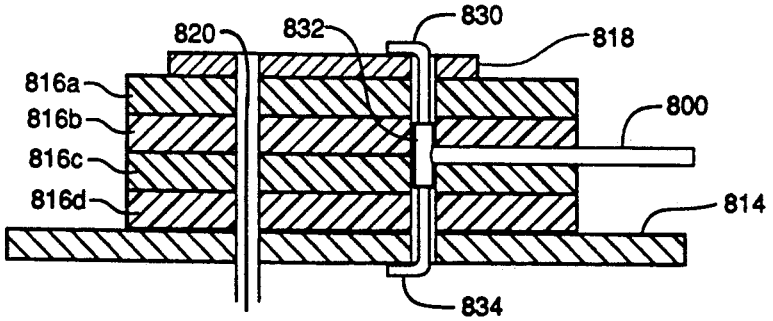

FIGS. 8, 8*a* and 8*b* are views of an embodiment similar to that of FIG. 2, showing how a fiberoptical glass fiber 800 may be embedded in the dielectric. FIG. 8 is a top view showing the orientation of the fiber 800. FIG. 8*a* is a cross section view of the antenna, to show a cross section of the glass fiber 800, embedded between layers of the dielectric 816. FIG. 8*b* is a cross section view along the length of the glass fiber 800, showing the fiber 800 coupled to an optically controlled diode 832. Like in FIG. 2, the antenna comprises a ground plane 814, a dielectric layer 816, and a patch element 818. A feed point 820 corresponds to feed point 220 of FIG. 2. The diode 832 has a lead connected to the radiating element 818 at point 830, and a lead connected to the ground plane at point 834. In FIGS. 8*a* and 8*b*, the dielectric 816 is shown as comprising four layers 816*a*, 816*b*, 816*c* and 816*d*. The glass fiber 800 is shown embedded between layers 816*b* and 816*c*.

The fact that the tape antenna is fabricated with multiple thin layers of tape dielectric allows one to construct a series of layers that are not necessarily uniform in thickness or dielectric constant, and can vary in direction and spatial position. FIGS. 3–7 are schematic representations of this characteristic. This feature allows one to easily produce steps and graded thickness characteristics within the antenna dielectric structure, thereby providing for the possibility that modes other than the conventional modes of resonance might be set up within the antenna and alter the frequency, bandwidth, and spatial field pattern of operation. This provides for adaptive control of antennas that is not available with conventionally fabricated antennas.

Figure 4:
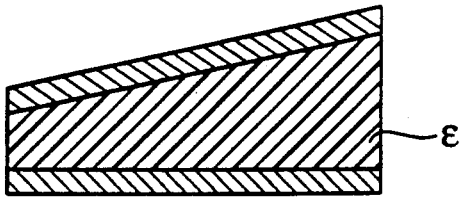
Figure 5:
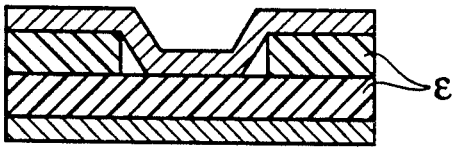

FIG. 3 shows the patch antenna in which the dielectric layer is of uniform thickness and homogeneous in the dielectric constant $\epsilon$. FIGS. 4 and 5 show patch antennas in which the dielectric layer is of non-uniform thickness but homogeneous in the dielectric constant $\epsilon$. FIG. 4 shows a continuously variable thickness, and FIG. 5 shows a case with stepped thickness with layers of insulating tape, being thinner in the center. There are several possible variations of non-uniform thickness, such as thin at one end, and increasing in thickness toward the other end. Also the feed point be at various places with respect to the thick and thin areas.

Figure 6:
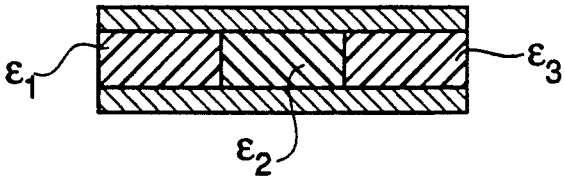
Figure 7:
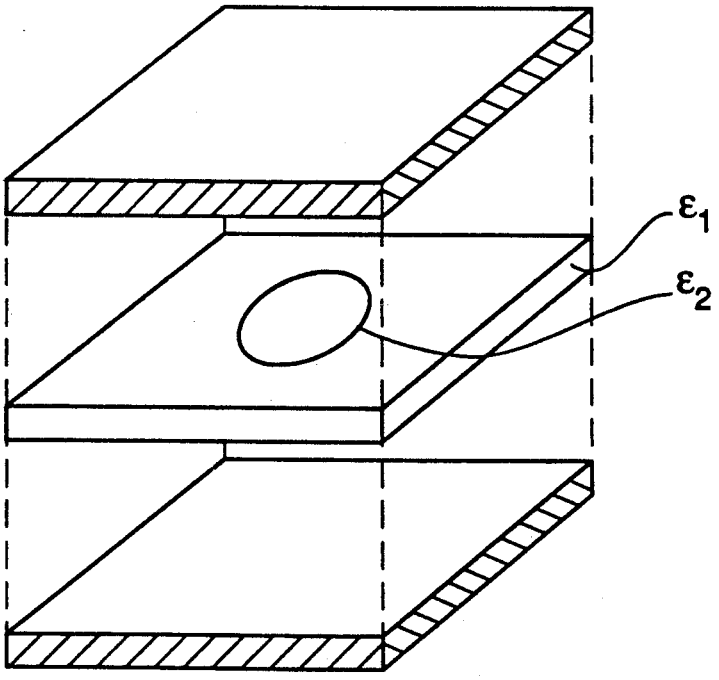
FIG. 7 is an exploded view, showing modifications of the thickness and dielectric constant for the insulating layer to provide different radiating characteristics.

FIGS. 6 and 7 show patch antennas in which the dielectric layer is of uniform thickness but non-homogeneous in the dielectric constant. FIG. 6 shows the insulating layer having three strips of tape with respective dielectric constants of $\epsilon_1$, $\epsilon_2$ and $\epsilon_3$. FIG. 7 is an exploded view of a patch antenna, in which the insulating layer has a shaped dielectric $\epsilon_1$, and a portion in the center having a dielectric constant $\epsilon_2$.

The dielectric layer and active element are made of a tape material and therefore can be shaped to conform to the surface of the device on which they are being applied. Thus these devices provide a natural technique for constructing conformal antenna structures.

One application of the antenna structure described above is to the telemetry of data from various flying vehicles such as aircraft, missiles, and projectiles. The new technology involved makes realizable and practical the concept of adaptive peel-and-stick antenna systems. That is, a subminiature patch microstrip antenna can be dispensed from a roll of generic patch antenna devices and attached to a desired surface by exposing the adhesive underside of the antenna through removal of a covering release sheet.

The invention provides a structure for a telemetry antenna that is easily attached to a munition just prior to testing. The antenna is simple and easily adaptable to various mounting conditions. The potential for use of munitions of sizes from that of a baseball to the size of a large space vehicle requires that the antenna be able to withstand severe environmental conditions including temperature, wind forces, and potentially, plasma effects.

It is understood that certain modifications to the invention as described may be made, as might occur to one with skill in the field of the invention, within the scope of the appended claims. Therefore, all embodiments contemplated hereunder which achieve the objects of the present invention have not been shown in complete detail. Other embodiments may be developed without departing from the scope of the appended claims.

What is claimed is:

1. A patch antenna comprising a radiating element formed from electrically conductive tape having an upper surface and a lower surface with adhesive on the lower surface, a dielectric formed from electrically insulating tape having an upper surface and a lower surface with adhesive on the lower surface, a ground plane formed from electrically conductive tape having an upper surface and a lower surface, with the lower surface of the radiating element attached to the upper surface of the dielectric, and the lower surface of the dielectric attached to the upper surface of the ground plane;

wherein the patch antenna is mounted to a non-planar surface of a vehicle by means of structural tape adhesives attaching the lower surface of the ground plane to said non-planar surface; and wherein the dielectric is non-uniform in the dimension between the radiating element and the ground plane, and is formed from a plurality of layers of the electrically insulating tape, with one layer having its lower surface attached to the upper surface of the ground plane, successive layers having the lower surface attached to the upper surface of the preceding layer, and the last layer having the lower surface of the radiating element attached to its upper surface.

2. A patch antenna according to claim 1, wherein the dielectric comprises sections of the electrically insulating tape which have different constants.

3. A patch antenna according to claim 1, wherein a device is connected between the radiating element and the ground plane, with means for changing the impedance of the device to vary the radiating characteristics of the antenna.

4. A patch antenna according to claim 1, wherein said device is an optically controlled diode; and wherein the means for changing the impedance of the device includes an optical waveguide structure integrated into the patch antenna embedded between layers of the dielectric.

5. A method of mounting a patch antenna to a non-planar surface of a vehicle, using a first roll of electrically conductive tape having an upper surface and a lower surface with adhesive on the lower surface, and a covering release sheet protecting the adhesive on the lower surface, with radiating elements formed in the electrically conductive tape, a roll of electrically insulating tape having an upper surface and a lower surface with adhesive on the lower surface, and a second roll of electrically conductive tape having an upper surface and a lower surface;

said method comprising the steps:

cutting a radiating element from said first roll and removing the covering release sheet from the radiating element;

forming a dielectric layer form the roll of electrically insulating tape and attaching the lower surface of the radiating element to the upper surface of the dielectric layer;

forming a ground plane from the second roll of electrically conductive tape and attaching the lower surface of the dielectric layer to the upper surface of the ground plane; and mounting the patch antenna by means of structural tape adhesives attaching the second surface of the ground plane to said non-planar surface.

6. A method according to claim 5, further including forming a radome from another layer of electrically insulating tape having an upper surface and a lower surface with adhesive on the lower surface, by attaching the lower surface of the radome to the upper surface of the radiating element.

7. A method according to claim 5, including forming the dielectric from a plurality of layers of the electrically insulating tape, attaching one layer with its lower surface to the upper surface of the ground plane, and attaching successive layers with the lower surface attached to the upper surface of the preceding layer, and attaching the lower surface of the radiating element to upper surface of the last layer of the dielectric.

8. A method according to claim 7, wherein the dielectric is made non-uniform in the dimension between the radiating element and the ground plane.

9. A method according to claim 8, wherein the dielectric is formed with sections of the electrically insulating tape which have different dielectric constants.

10. A method according to claim 5, including forming the dielectric from a plurality of layers of the electrically insulating tape, attaching one layer with its lower surface to the upper surface of the ground plane, and attaching successive layers with the lower surface attached to the upper surface of the preceding layer, while embedding an optical waveguide structure between two of said successive layers of the dielectric, providing an optically controlled diode, coupling the optical waveguide structure to the optically controlled diode to provide for changing the impedance of the device to vary the radiating characteristics of the antenna, attaching the lower surface of the radiating element to the upper surface of the last layer of the dielectric, and connecting the optically controlled diode between the radiating element and the ground plane.

11. A method of mounting a patch antenna to a non-planar surface of a vehicle, using a first roll of electrically conductive tape having an upper surface and a lower surface with adhesive on the lower surface, and a covering release sheet protecting the adhesive on the lower surface, with radiating elements formed in the electrically conductive tape, a roll of electrically insulating tape having an upper surface and a lower surface with adhesive on the lower surface, and a roll of copper tape having an upper surface and a lower surface;

said method comprising the steps:

a. forming a ground plane from the roll of copper tape to provide a bar copper substrate, b. punching a hole through the ground plane to pass a feed structure in a position that will allow the patch antenna to be placed approximately in the center of the ground plane, c. cleaning the ground plane to provide a good soldering surface and improve adhesion of tape elements to the surface, d. tinning a ring around the hole, e. tinning an interface connector and soldering the interface connector and ground plane together with the center conductor of the connector centered in the feed hole, f. using at least one layer form the roll of electrically insulating tape to form a dielectric, attaching the lower surface of the dielectric to the upper surface of the ground plane, g. using a radiating element from the first roll of electrically conductive tape, attaching the lower surface of the radiating element to the upper surface of the dielectric and soldering the center conductor of the connector to the radiating element.

12. A method according to claim 11, further including forming a radome from another layer of electrically insulating tape having an upper surface and a lower surface with adhesive on the lower surface, by attaching the lower surface of the radome to the upper surface of the radiating element.

* * * * *

UNITED STATES PATENT AND TRADEMARK OFFICE

CERTIFICATE OF CORRECTION

PATENT NO. : 5,155,493

DATED : October 13, 1992

INVENTOR(S) : Michael H. Thursby et al

It is certified that error appears in the above-identified patent and that said Letters Patent is hereby corrected as shown below:

Column 1, line 28, the first period should be a comma.

Column 3, line 54, "fiberoptical" should be --fiberoptic--.

Column 5, line 61, (claim 5) "form" should be --from--.

Column 6, line 52 (claim 11) "bar" should be --bare--.

Column 6, line 65 (claim 11) "form" should be --from--.

Signed and Sealed this

Nineteenth Day of October, 1993

*Attest:*

*Attesting Officer*

BRUCE LEHMAN

*Commissioner of Patents and Trademarks*